US008245324B2

(12) United States Patent
Kawasaki et al.

(10) Patent No.: US 8,245,324 B2
(45) Date of Patent: Aug. 21, 2012

(54) BOTTOM GARMENT

(75) Inventors: Reiko Kawasaki, Kyoto (JP); Yoshihisa Shinagawa, Kyoto (JP)

(73) Assignee: Wacoal Corp., Kyoto (JP)

( * ) Notice: Subject to any disclaimer, the term of this patent is extended or adjusted under 35 U.S.C. 154(b) by 927 days.

(21) Appl. No.: 11/569,416

(22) PCT Filed: May 18, 2005

(86) PCT No.: PCT/JP2005/009063

§ 371 (c)(1),
(2), (4) Date: Jan. 3, 2007

(87) PCT Pub. No.: WO2005/112674

PCT Pub. Date: Dec. 1, 2005

(65) Prior Publication Data

US 2007/0214541 A1 Sep. 20, 2007

(30) Foreign Application Priority Data

May 20, 2004 (JP) ..... P2004-150906

(51) Int. Cl.
*A41D 1/06* (2006.01)
*A41D 13/02* (2006.01)
*A41D 13/00* (2006.01)

(52) U.S. Cl. ..... 2/227; 2/69

(58) Field of Classification Search ..... 2/401, 404, 2/227, 228, 69
See application file for complete search history.

(56) References Cited

U.S. PATENT DOCUMENTS

| | | | | |
|---|---|---|---|---|
| 4,910,802 | A * | 3/1990 | Malloy | 2/69 |
| 5,201,074 | A * | 4/1993 | Dicker | 2/70 |
| 5,367,708 | A * | 11/1994 | Fujimoto | 2/22 |
| 5,960,474 | A * | 10/1999 | Dicker et al. | 2/69 |
| 6,186,970 | B1 * | 2/2001 | Fujii et al. | 602/75 |
| 6,231,488 | B1 * | 5/2001 | Dicker et al. | 482/124 |
| 6,401,497 | B1 | 6/2002 | Nishiyama et al. | |
| 7,229,390 | B2 * | 6/2007 | Fujii et al. | 482/124 |
| 7,631,366 | B2 * | 12/2009 | Oyama et al. | 2/228 |
| 7,670,205 | B2 * | 3/2010 | Oyama et al. | 450/97 |
| 7,677,953 | B2 | 3/2010 | Oyama et al. | |
| 7,730,552 | B2 * | 6/2010 | Ota et al. | 2/69 |
| 2003/0028952 | A1 * | 2/2003 | Fujii et al. | 2/400 |

(Continued)

FOREIGN PATENT DOCUMENTS

EP 1618804 1/2006

(Continued)

OTHER PUBLICATIONS

JP11061516A MT (Machine Translation).*

(Continued)

*Primary Examiner* — Alissa L Hoey
*Assistant Examiner* — Amber Anderson
(74) *Attorney, Agent, or Firm* — Leydig, Voit & Mayer, Ltd.

(57) ABSTRACT

Filler clothes 3, which intersect with each other at a section corresponding to the middle point between the interspinal point and patellar midpoint of a human body, are formed on a front section of a bottom garment 1. The filler clothes 3 which are formed in this manner stimulates the rectus femoris muscle 14 which is a part of the quadriceps of a wearer. When the quadriceps is stimulated while walking, the legs can be kicked backward significantly in a natural fashion, whereby the gluteus maximus muscles can be used efficiently.

2 Claims, 14 Drawing Sheets

U.S. PATENT DOCUMENTS

| | | | | |
|---|---|---|---|---|
| 2003/0101506 | A1* | 6/2003 | Fujii et al. | 2/240 |
| 2004/0111781 | A1* | 6/2004 | Miyake et al. | 2/69 |
| 2004/0255358 | A1* | 12/2004 | Ota et al. | 2/69 |

FOREIGN PATENT DOCUMENTS

| | | | |
|---|---|---|---|
| EP | 1897983 | | 3/2008 |
| JP | 11-61516 | A1 | 3/1999 |
| JP | 2001-192903 | | 7/2001 |
| JP | 2002-212814 | A | 7/2002 |
| JP | 2004-100143 | A | 4/2004 |
| KR | 2001-0025516 | | 4/2001 |
| TW | 475887 | | 2/2002 |

OTHER PUBLICATIONS

JP11-061516 (machine translation), Mar. 1999.*
International Preliminary Report on Patentability for PCT/JP2005/009063 issued Nov. 21, 2006.
International Search Report for PCT/JP2005/009063 mailed Jul. 19, 2005.
Patent Abstracts of Japan for JP2002-212814 published Jul. 31, 2002.
Patent Abstracts of Japan for JP11-61516 published Mar. 5, 1999.
Patent Abstracts of Japan for JP2004-100143 published Apr. 2, 2004.
Taiwanese Patent Office, Office Action, May 26, 2011, for TW Application No. 094116466.

* cited by examiner

*Fig.9*

| HEIGHT | INTERSPINAL POINT TO PATELLAR MIDPOINT | (INTERSPINAL POINT TO PATELLAR MIDPOINT)/2 |
|---|---|---|
| 151.2 | 43.1 | 21.6 |
| 151.4 | 41.3 | 20.7 |
| 156.2 | 43.2 | 21.6 |
| 157.4 | 43.8 | 21.9 |
| 161.1 | 46.6 | 23.3 |
| 163.8 | 45.7 | 22.9 |
| 164.5 | 45.7 | 22.9 |
| 165.5 | 47.6 | 23.8 |
| 166.4 | 47.0 | 23.5 |
| 169.9 | 47.7 | 23.9 |

*Fig.12*

| SAMPLE | INTERSECTING PART | BACK SECTION |
|---|---|---|
| A | 28.8 | 17.4 |
| B | 37.1 | 20.4 |
| C | 35.5 | 21.5 |
| D | 37.5 | 21.3 |
| E | 51.4 | 35.2 |
| F | 22.5 | 18.8 |

*Fig.14*

| | |
|---|---|
| BUTTOCKS HAVE RISEN | 6／10 |
| BUTTOCKS BECAME LARGER | 1／10 |
| BUTTOCKS BECAME SMALLER | 5／10 |
| THIGHS BECAME THINNER | 9／10 |
| COMFORTABLE | 8／10 |

BOTTOM GARMENT

CROSS-REFERENCE TO PRIOR APPLICATION

This is a U.S. National Phase Application under 35 U.S.C. §371 of International Patent Application No. PCT/JP2005/009063 filed May 18, 2005, and claims the benefit of Japanese Patent Application No. 2004-150906, filed May 20, 2004, both of which are incorporated by reference herein as if set forth in their entirety. The International Application was published in Japanese on Dec. 1, 2005 as WO 2005/112674 A1 under PCT Article 21(2).

TECHNICAL FIELD

The present invention relates to a bottom garment used for lifting up the buttocks.

BACKGROUND ART

Japanese Patent Application Laid-Open No. 2002-212814 discloses a garment for leg strength enhancement which enhances the desired muscles easily only by living an ordinary life. On this garment for leg strength enhancement, a strong elastic portion is disposed in a direction extending along a muscle to directly give a load to the muscle from this strong elastic portion, whereby the muscle strength is enhanced. Specifically, by providing a load directly to an enhancement-target muscle, the muscle is developed.

An object of the garment for leg strength enforcement described in Japanese Patent Application Laid-Open No. 2002-212814 is to enhance the muscle strength of the section where the strong elastic portion is disposed, thus it is not always possible to obtain a beautiful figure. For example, as shown in FIG. 2 in Japanese Patent Application Laid-Open No. 2002-212814, an elongated strip-shaped strong elastic portion is provided on each buttock. However, in this case, only the strength of the muscles around the buttocks where the strong elastic portions are disposed is enhanced. Therefore, in this case, it is difficult to lift up the buttocks neatly.

An object of the present invention therefore is to provide a bottom garment capable of lifting up the buttocks neatly.

DISCLOSURE OF THE INVENTION

The bottom garment of the present invention is characterized in comprising tightening portions at a section corresponding to a middle point between the interspinal point and the patellar midpoint of the human body, the middle point being located on a front side of a thigh. When such a bottom garment is worn, the tightening portions abut on the section corresponding to the middle point between the interspinal point and the patellar midpoint of the human body, thus strong locking force can be added to the quadriceps located in this section. Accordingly, the quadriceps is stimulated, thus naturally the leg can be raised backward significantly so that the gluteus maximus muscle is used. Therefore, by wearing the bottom garment of the present invention, a beautiful hipline can be formed easily.

In the bottom garment of the present invention, preferably the wearing pressure, when the garment is worn, at the tightening portions is at least 30 [gf/cm$^2$], the wearing pressure, when the garment is worn, at sections other than the tightening portions is equal to or less than 30 [gf/cm$^2$], and the differential pressure between the pressure at the tightening portions and the wearing pressure, when the garment is worn, at the sections other than the tightening portions is at least 10 [gf/cm$^2$]. Accordingly, the quadriceps can be stimulated without applying a feeling of tightness to the wearer. Therefore, a bottom garment in which the gluteus maximus muscle can be used and which does not provide a feeling of tightness to the wearer can be provided.

In the bottom garment of the present invention, preferably the tightening portions intersect with each other at the section corresponding to the middle point. Accordingly, the intersecting part of the tightening portions is applied with a stronger tightening force, whereby the section corresponding to the middle point between the interspinal point and patellar midpoint can be further stimulated. Therefore, a more beautiful hipline can be formed more easily.

In the bottom garment of the present invention, preferably, the relationship among the wearing pressure, when the garment is worn, at the intersecting part of the tightening portions, the pressure at a section in the tightening portions other than the intersecting part, and the wearing pressure, when the garment is worn, at a section other than the tightening portions, when the garment is worn, is expressed as "the wearing pressure, when the garment is worn, at the intersecting part>the pressure at the section in the tightening portions other than the intersecting part, when the garment is worn>the pressure at the section other than the tightening portions, when the garment is worn. Moreover, preferably the wearing pressure, when the garment is worn, at the intersecting part of the tightening portions is 30 through 60 [gf/cm$^2$], the pressure at the section in the tightening portions other than the intersecting part is 15 through 50 [gf/cm$^2$], and the wearing pressure, when the garment is worn, at the section other than the tightening portions is 0 through 30 [gf/cm$^2$]. Accordingly, the quadriceps can be stimulated without applying a feeling of tightness to the wearer. Therefore, a bottom garment in which the gluteus maximus muscle can be used and which does not provide a feeling of tightness to the wearer can be provided.

In the bottom garment of the present invention, preferably the wearing pressure, when the garment is worn, at the intersecting part of the tightening portions is 1.2 through 3.7 times the pressures at eight peripheral regions of an upper side, upper right side, right side, lower right side, lower side, lower left side, left side, and upper left side with respect to the intersecting part. Moreover, the wearing pressure, when the garment is worn, at the intersecting part of the tightening portions is preferably 1.2 through 1.6 times the wearing pressure, when the garment is worn, at a peripheral region of the eight peripheral regions, which is on the tightening portions, and is preferably 1.9 through 3.7 times the wearing pressure, when the garment is worn, at a peripheral region of the eight peripheral regions, which is located in a section other than the tightening portions. Accordingly, the quadriceps can be stimulated without applying a feeling of tightness to the wearer. Therefore, a bottom garment in which the gluteus maximus muscle can be used and which does not provide a feeling of tightness to the wearer can be provided.

In the bottom garment of the present invention, preferably the middle point is located within an area in which the ratio between the length extending from the interspinal point to the middle point and the length extending from the middle point to the patellar midpoint is 4:6 through 6:4. Accordingly, the intersecting part of the tightening portion can be positioned at substantially the center of the quadriceps, so that the quadriceps can be stimulated effectively.

According to the bottom garment of the present invention, an excellent effect that the buttocks can be lifted up neatly and easily can be expected.

BRIEF DESCRIPTION OF THE DRAWINGS

FIG. 9 is a figure showing the sizes of human bodies in the trial, whose heights are different from one another;

FIG. 12 is a figure showing the wearing pressure, when the garment is worn, at each measuring point on each sample;

FIG. 14 is a figure for explaining the feeling of wearing of the garment obtained from the testers.

BEST MODE FOR CARRYING OUT THE INVENTION

Figure 1:
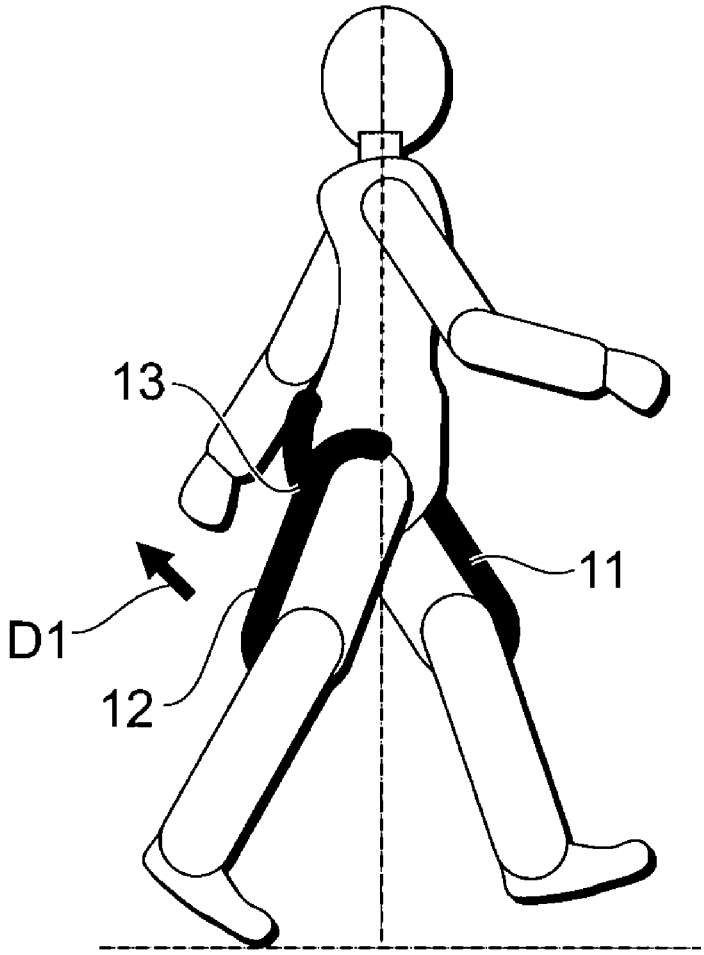
FIG. 1 is a side view showing a walking man.
Figure 2:
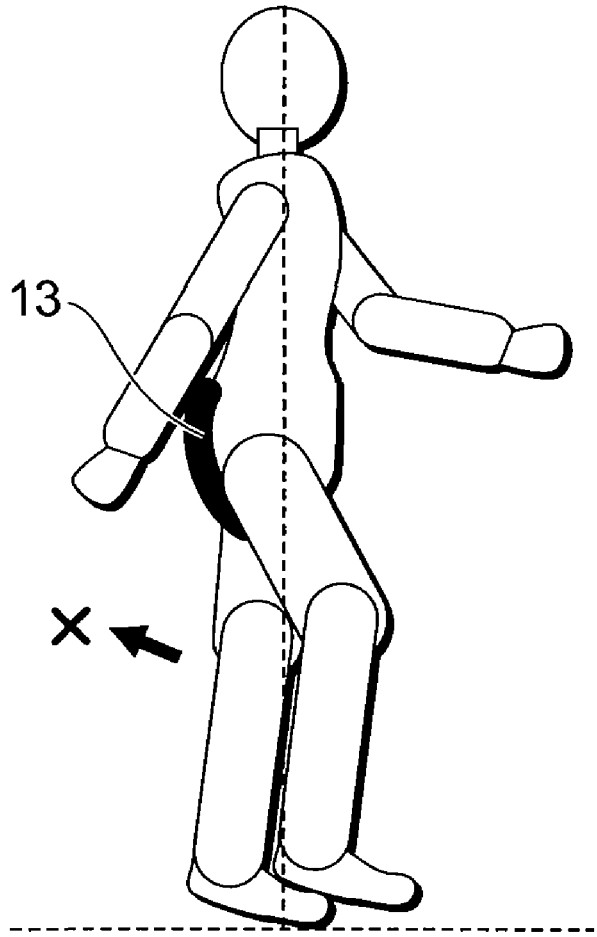
FIG. 2 is a side view showing a walking man.

Before explaining the embodiment, firm buttocks (beautiful hipline) as a background of the invention of the present application is described with reference to FIG. 1 and FIG. 2. FIG. 1 and FIG. 2 are side views showing a walking man.

In order to realize firm buttocks, the inventors of the present application have focused attention on the fact that firm buttocks can be achieved by exercising the gluteus maximus muscles. Here, the gluteus maximus muscles are the muscles exercised by raising the legs backward widely. Therefore, by widely kicking the legs backward when walking, the gluteus maximus muscles can be exercised, and firm buttocks can be achieved.

FIG. 1 is a figure for explaining a way of walking using the gluteus maximus muscles well. As shown in FIG. 1, quadriceps 11 is located at the front side of a thigh, and biceps 12 is located on the back of the thigh. The quadriceps 11 is a muscle for mainly extending a knee, and the biceps 12 is a muscle for mainly kicking the leg backward. As shown in FIG. 1, by widely raising the leg backward (in a direction of an arrow D1), gluteus maximus muscle 13 is flexed. Therefore, by walking in this manner, kicking the leg widely backward, the gluteus maximus muscles 13 can be used well. On the other hand, FIG. 2 is a figure for explaining a way of walking in which the gluteus maximus muscle is hardly used. As shown in FIG. 2, for example, when walking with knees bent, the legs cannot be swung high and backward, thus the gluteus maximus muscles 13 are not flexed. That is, the gluteus maximus muscles 13 are in the relaxed state. Therefore, when walking with knees bent, the gluteus maximus muscles 13 are hardly used.

There are a number of people who want to tighten their buttocks, and many of them try to walk on regular basis in order to maintain their figures. The inventors of the present application therefore have discovered that, if a walking for tightening the buttocks, i.e. a walking by largely kicking legs backward, can be performed on regular basis, tight buttocks can be realized simply by performing such walking, and thus have completed the present invention.

Hereinafter, the embodiment of the present invention is described with reference to the drawings. It should be noted that the same reference numerals are used to indicate the same elements, thus the overlapping explanations are omitted accordingly.

Figure 3:
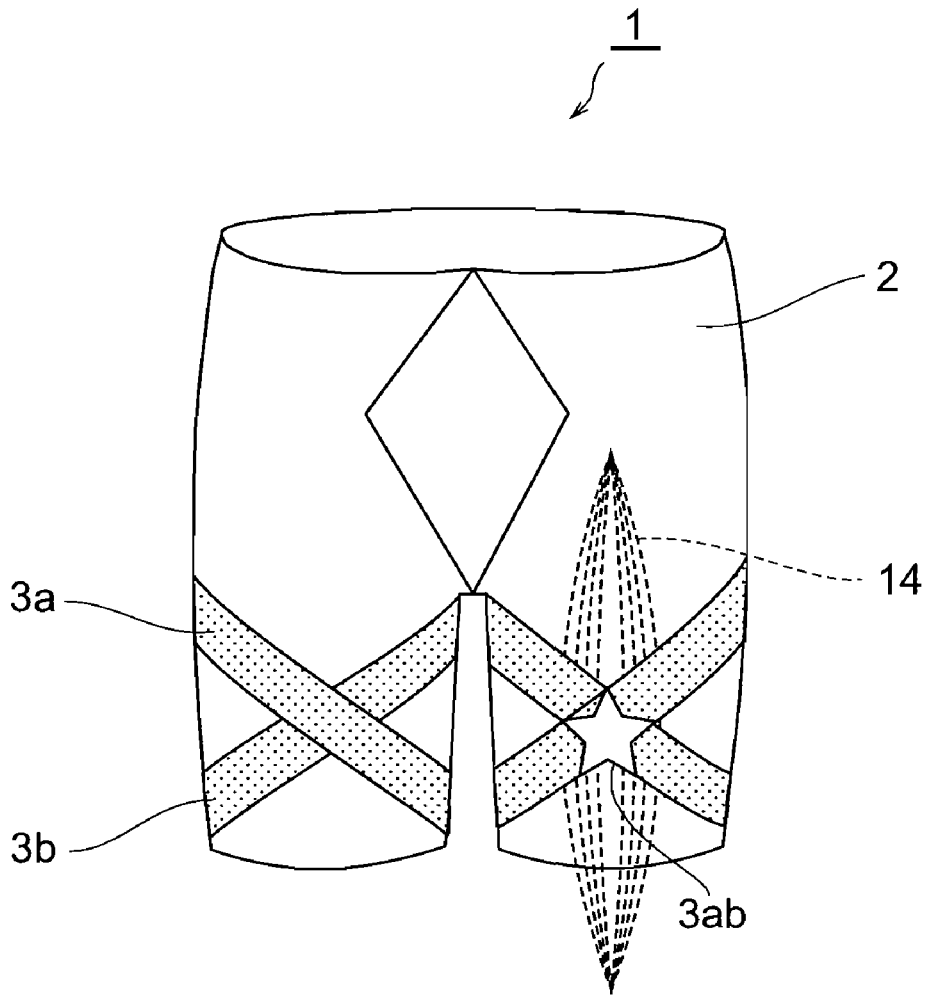
FIG. 3 is a figure showing a girdle in the present embodiment.

From the perspective of the above explanations, the inventors of the present application have created a bottom garment shown in FIG. 3. The bottom garment 1 shown in FIG. 3 is a girdle used for hip exercise, and the length thereof extends from a waist line to above knee regions. The girdle is formed into a cylinder by stitching a front body and a rear body together. The bottom garment 1 is constituted by a main body portion 2 and filler cloths (tightening portions) 3*a* and 3*b*. It should be noted that, hereinafter, when it is not particularly necessary to distinguish between the filler cloth 3*a* and the filler cloth 3*b*, the filler clothes are described simply as "filler clothes 3". The filler clothes 3 are formed into strips at a front side part of a thigh and intersect with each other at the vicinity of the center of the thigh. Specifically, the filler cloth 3*b* extends from the groin to pass the front side of the thigh and further extends obliquely downward to reach the outside of the leg. On the other hand, the filler cloth 3*a* extends from the outside of the leg located at substantially the same height as the groin, to reach the front side and further extends obliquely downward to reach the inner side of the leg. The filler clothes 3*a* and 3*b* intersect with each other at the vicinity of the center at the front side of the thigh and forms a diamond-shaped intersecting part 3*ab*. The intersecting part 3*ab* of the filler clothes 3 is formed at a position where the rectus femoris muscle 14 which is a part of the quadriceps 11 is stimulated. It should be noted that the tightening portions in this case is a part which is constituted from a fabric having lower degree of shrinkage than that of the fabrics of the main body portion and to which strong pressure is applied when the garment is worn, compared to peripheral portions.

Figure 4:
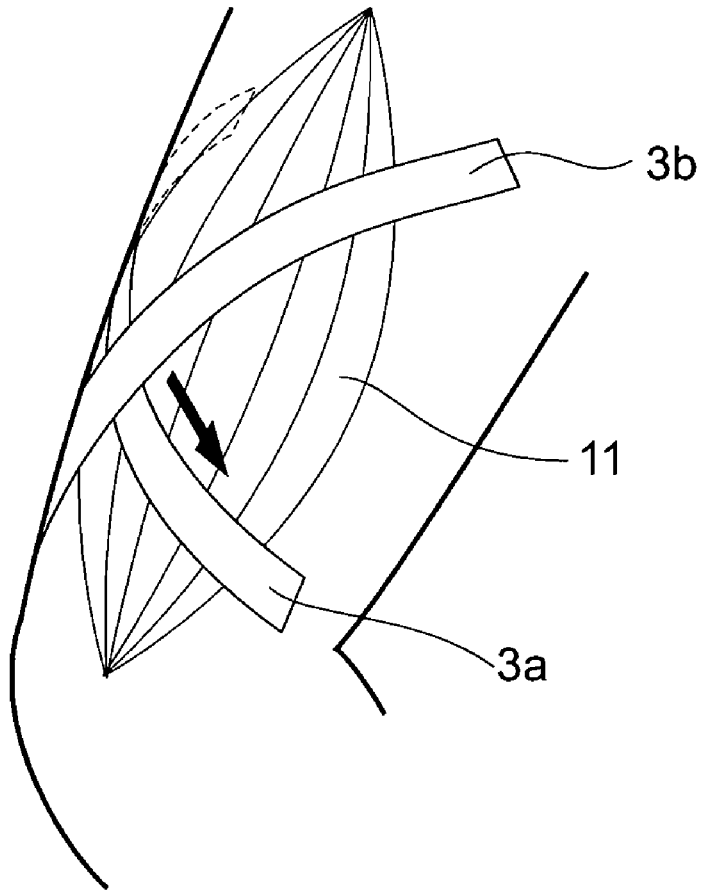
FIG. 4 is a figure for explaining a principle in which a gluteus maximus muscle is used when walking.

Next, FIG. 4 through FIG. 7 are used to describe the principle in which the gluteus maximus muscle is used when a wearer of the bottom garment 1 walks. First of all, as shown in FIG. 4, when by the wearer raising a leg forward when starting to walk, tightening force is applied to the quadriceps 11 of the wearer from the filler clothes 3, and the quadriceps 11 is stimulated by this tightening force. It should be noted that the tightening force means a force which is received from the bottom garment when the garment is worn.

Figure 5:
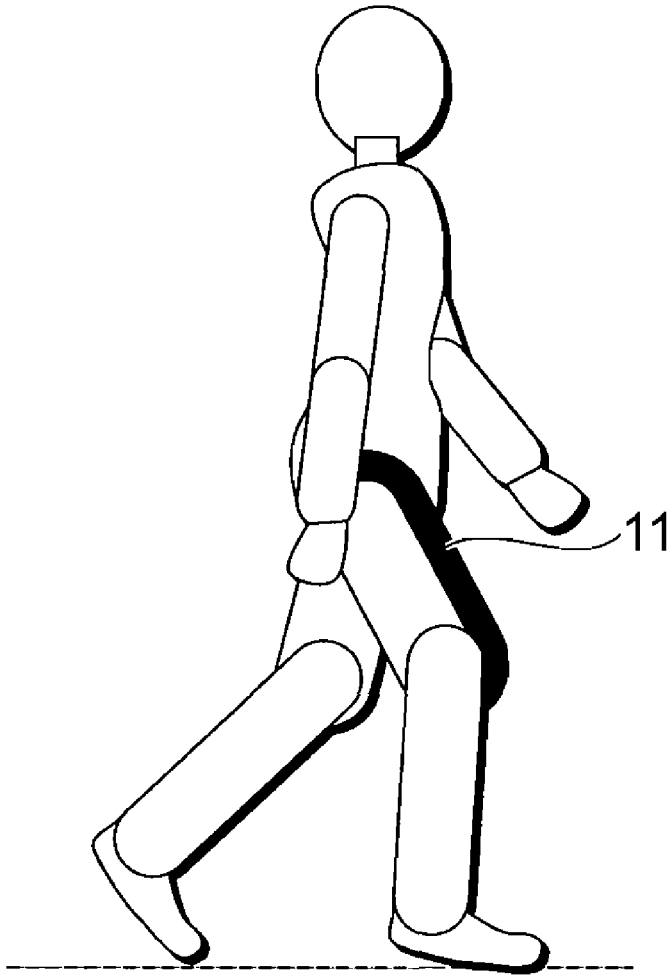
FIG. 5 is a figure for explaining a principle in which a gluteus maximus muscle is used when walking.

Here, since the filler clothes 3*a* and 3*b* are formed to intersect with each other are in the form of strips, the muscles can be stimulated without impeding the functions of the muscles. Therefore, as shown in FIG. 5, when a leg is raised forward and the quadriceps is stimulated, an extension movement of the knee is increased.

Figure 6:
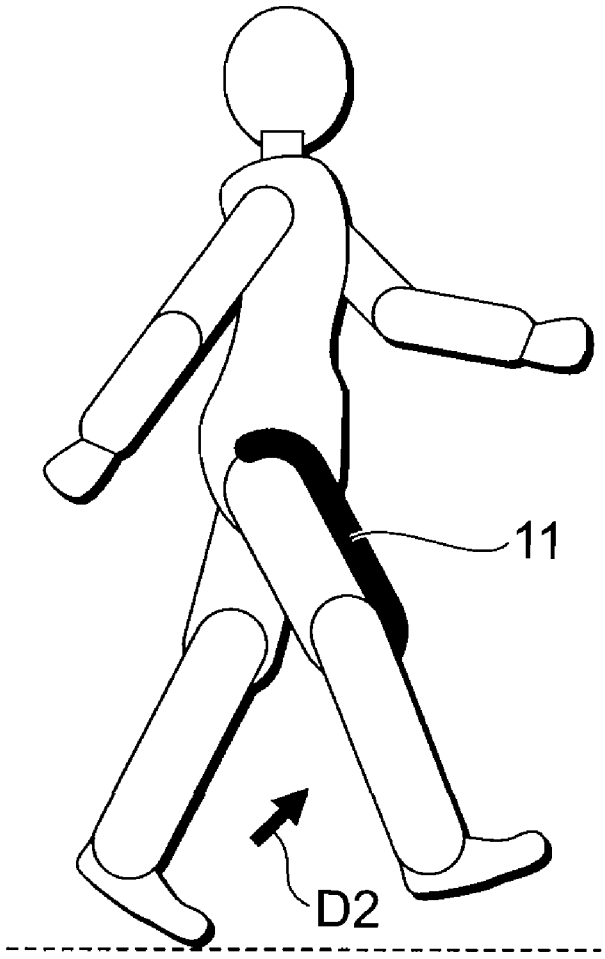
FIG. 6 is a figure for explaining a principle in which a gluteus maximus muscle is used when walking.
Figure 7:
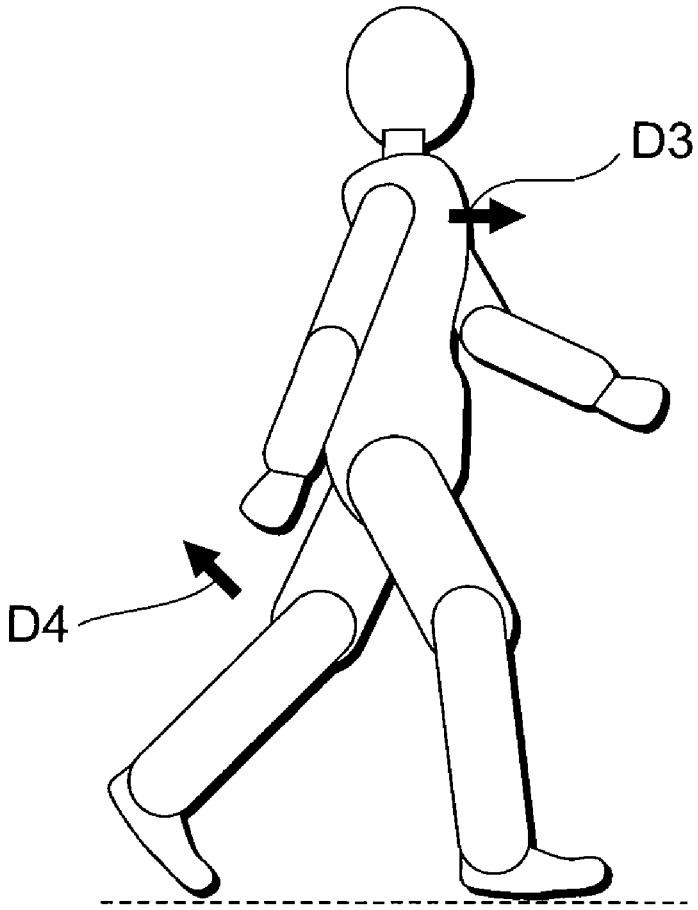
FIG. 7 is a figure for explaining a principle in which a gluteus maximus muscle is used when walking.

When the extension movements of the knees increase, a blow knee region is swung upward in a direction of an arrow D2 as shown in FIG. 6, and the knee is stretched, whereby the length of stride of the wearer becomes wide. When the length of stride increases, the wearer cannot avoid moving his body farther forward (direction of an arrow D3) as shown in FIG. 7, compared to when a conventional bottom garment is worn, and as a result the legs are kicked significantly backward (direction of an arrow D4). Accordingly, the gluteus maximus muscle can be exercised.

Figure 8:
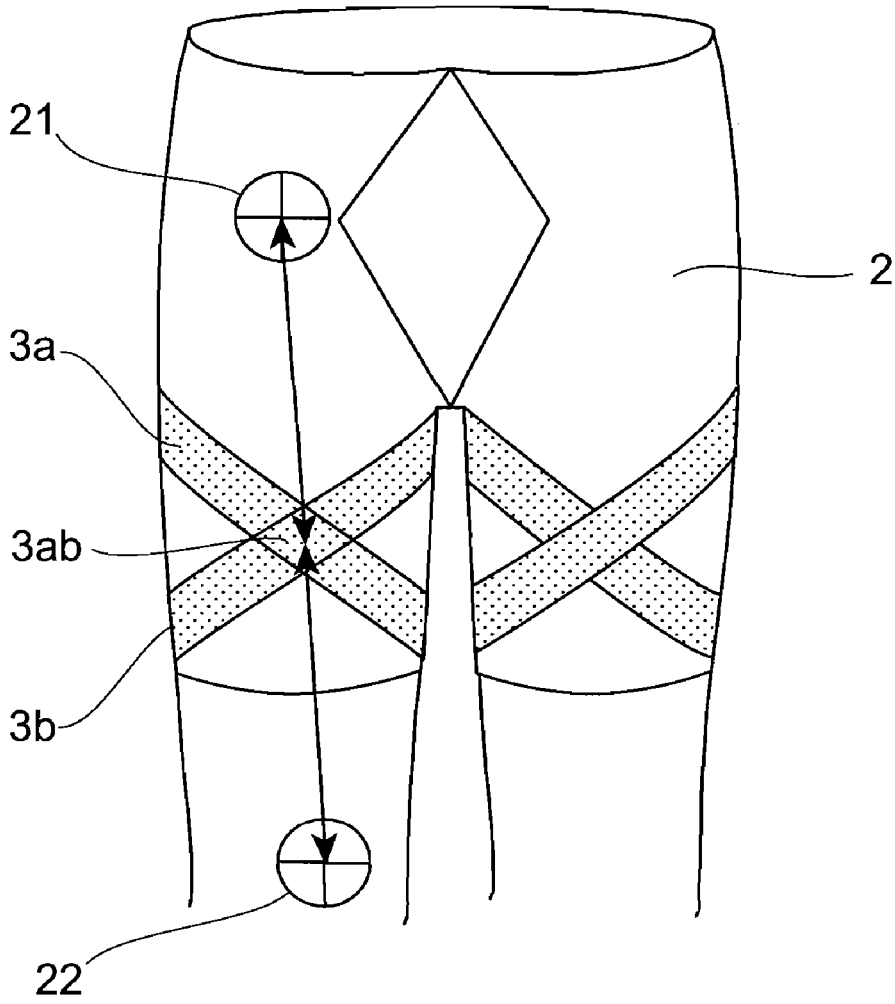
FIG. 8 is a figure in which the lower body of the man wearing the girdle of the present embodiment is viewed from the front.

Next, the position of the filler cloth intersecting part 3*ab* is described with reference to FIG. 8. As shown in FIG. 8, the filler cloth intersecting part 3*ab* is positioned at a part corresponding to a middle point (belly muscle of the rectus femoris muscle) between the interspinal (anterior superior iliac spine) point 21 and the patellar midpoint 22 of a human body when the bottom garment 1 is worn. Here, the middle point is preferably located within an area in which the ratio between the length extending from the interspinal point 21 to the middle point and the length extending from the middle point to the patellar midpoint 22 is "4:6" through "6:4". Accordingly, the filler cloth intersecting part 3*ab* is positioned at a substantially the center of the quadriceps, whereby the quadriceps can be stimulated further effectively.

Next, FIG. 9 is used to explain the sizes of human bodies in the trial, whose heights are different from one another. FIG. 9 shows, for the height of each tester, the length between the interspinal spinal point 21 and the patellar midpoint 22 and a value obtained by dividing the length between the interspinal point 21 and the patellar midpoint 22 of each tester by 2 (the length between the interspinal point 21 and the middle point between the interspinal point 21 and the patellar midpoint 22). It should be noted that the middle point between the interspinal point 21 and the patellar midpoint 22 is a middle point where the ratio between the length extending from the interspinal point 21 to the middle point and the length extending from the middle point to the patellar midpoint 22 is "5:5".

As shown in FIG. 9, the height of each trail is 151.2 [cm] through 169.9 [cm], and the length between the interspinal point 21 and the patellar midpoint 22 is 41.3 [cm] through 47.7 [cm]. The length between the interspinal point 21 and the middle point between the interspinal point 21 and the patellar midpoint 22 is 20.7 [cm] through 23.9 [cm]. Therefore, according to the results of the trials, if the height is 151.2 [cm] through 169.9 [cm], it is clear that the length between the interspinal point 21 and the middle point between the interspinal point 21 and the patellar midpoint 22 is 20.7 [cm] through 23.9 [cm].

Next, the bottom garment shown in FIG. 3 is put a dummy to measure the length between the interspinal point 21 of the dummy and the filler cloth intersecting part 3*ab* of the bottom garment 1. As a result, the length between the interspinal point 21 and an upper end of the intersecting part 3*ab* of the dummy was 16.5 [cm] and the length between the interspinal point 21 and a lower end of the intersecting part 3*ab* of the dummy was 23.5 [cm]. Therefore, in the bottom garment 1 worn by the dummy, if the middle point between the interspinal point 21 and the patellar midpoint 22 of the wearer is within a range of 16.5 [cm] through 23.5 [cm] from the interspinal point 21, the middle point is covered by the filler cloth intersecting part 3*ab*.

Here, the length between the interspinal point 21 and the middle point between the interspinal point 21 and the patellar midpoint 22 of each tester is 20.7 [cm] through 23.9 [cm] (see FIG. 9). Therefore, most of the middle point between the interspinal point 21 and the patellar midpoint 22 of each tester shown in FIG. 9 (the length ratio is "5.5") is covered by the filler cloth intersecting part 3*ab* of the bottom garment 1. For this reason, the filler cloth intersecting part 3*ab* of the bottom garment 1 inevitably covers a part of the region in which exists the middle point between the interspinal point 21 and the patellar midpoint 22 of each tester (the length ratio is "4:6" through "6:4").

Figure 10:
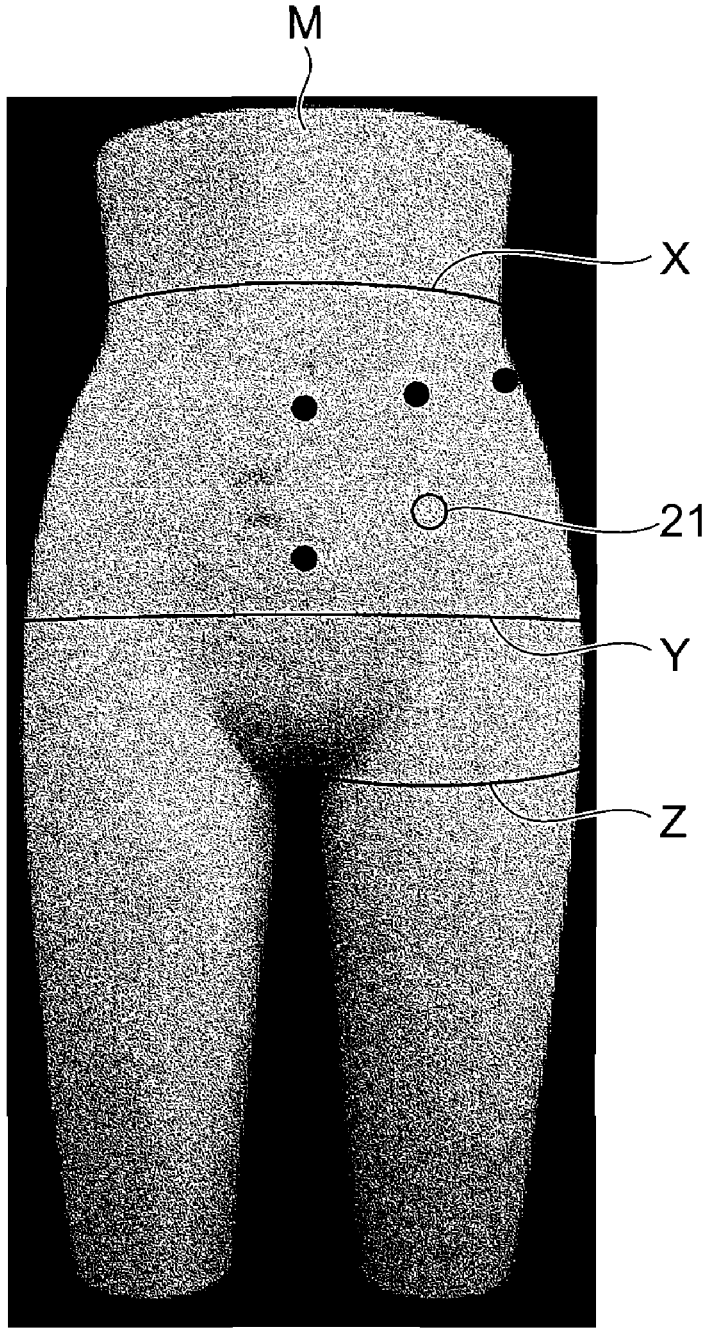
FIG. 10 is a front view of a dummy.

FIG. 10 is used to explain the size of each section the dummy (made of FRP) wearing the bottom garment 1. FIG. 10 shows only the lower body (knees to the upper waist) of the dummy M. As shown in FIG. 10, regarding the waist X of the dummy M, the length to the ground is 553 [mm], the peripheral diameter is 650 [mm], the lateral diameter is 230 [mm], and the depth is 165 [mm]. Regarding the hip Y of the dummy M, the length to the ground is 385 [mm], the peripheral diameter is 895 [mm], the lateral diameter is 320 [mm], and the depth is 215 [mm]. Regarding the top of a leg Z of the dummy M, the length to the ground is 285 [mm], the peripheral diameter is 520 [mm], the lateral diameter is 150 [mm], and the depth is 170 [mm]. Furthermore, regarding the section where the interspinal point of the dummy M is located, the length to the ground is 435 [mm], the peripheral diameter is 845 [mm], the lateral diameter is 305 [mm], and the depth is 202 [mm].

Figure 11:
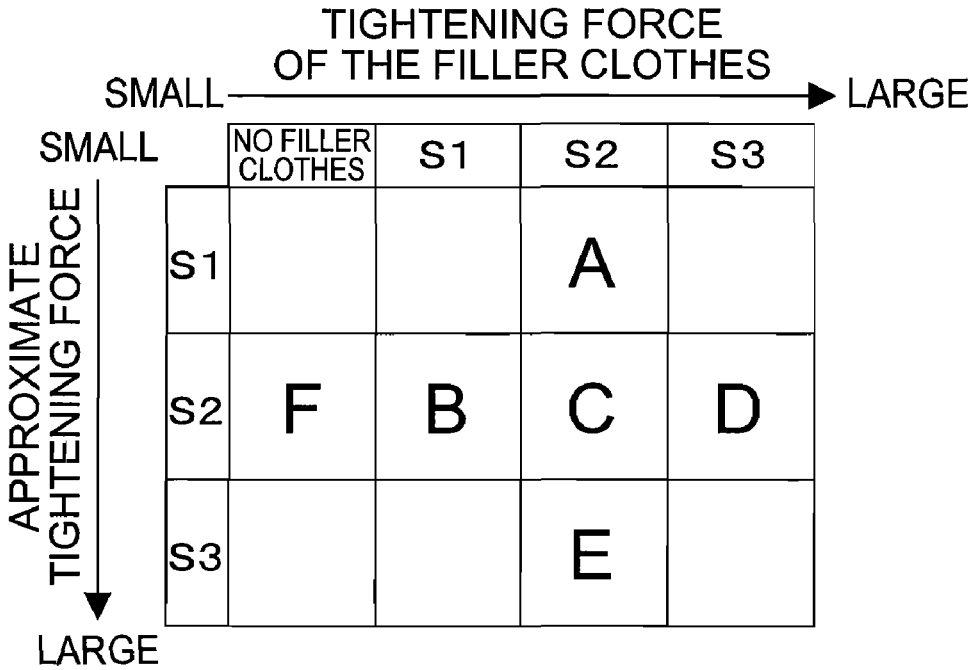
FIG. 11 is a figure showing the relationship between tightening force of a fabric configuring a main body portion and tightening force of a fabric configuring a filler cloth.

Next, FIG. 11 is used to explain the tightening force (power) of the fabrics configuring the main body portion 2 and the filler clothes 3 of the bottom garment 1. The inventors of the present application carried out an experiment for investigating what kind of effects are observed in the gluteus maximus muscles by applying the tightening force of the fabrics configuring the main body portion 2 and the filler clothes 3. In this experiment, a girdle in size 64 was as a sample and three types of fabrics having different tightening forces were used to configure the main body portion 2 and the filler clothes 3 of this sample. Of these fabrics, the fabric S1 has the strongest tightening force, the fabric S2 has the next strongest tightening force, and the fabric S3 has the weakest tightening force. To express these tightening forces in numeric values, in the present embodiment the pressure value of the fabric S1 is 17.4 [gf/cm$^2$], the pressure value of the fabric S2 is 21.5 [gf/cm$^2$], and the pressure value of the fabric S3 is 35.2 [gf/cm$^2$].

In a sample A shown in FIG. 11, the fabric S1 is used in the main body portion 2 and the fabric S2 is used in the filler clothes 3, and in a sample B the fabric S2 is used in the main body portion 2 and the fabric S1 is used in the filler clothes 3. In a sample C the fabric S2 is used in the main body portion 2 and the fabric S2 is used in the filler clothes 3, and in a sample D the fabric S2 is used in the main body portion 2 and the fabric S3 is used in the filler clothes 3. In a sample E the fabric S3 is used in the main body portion 2 and the fabric S2 is used in the filler clothes 3, and in a sample F the fabric S2 is used in the main body portion 2 and the filler clothes 3 is not formed.

Five testers are allowed to wear these samples A through F to perform an experiment for judging whether each of the samples A through F provides effective advantages on the gluteus maximus muscles. This experiment was performed under the following conditions. The wearers of the samples A through F were caused to walk on a treadmill at a speed of 4.2 km/h and an electromyography is used to perform measurement of the myoelectric potentials of the gluteus maximus muscles one minute after the walking is started. On the basis of the electromyograms obtained as a result of this measurement, the value of the RMS (Root Mean Square) during 16 seconds after the start of the measurement was calculated to derive the discharged amount of the gluteus maximus muscles. It should be noted that when obtaining the RMS value, 5 hz or lower component and 250 hz or higher component were cut from the components shown in the electromyogram.

The inventors of the present application decided to judge whether effective advantages are observed on the gluteus maximus muscles by judging whether the discharged amount in each of the samples A through E forming the filler clothes 3 is higher than the discharged amount in the sample F which does not form the filler clothes 3. Specifically, if the discharged amount in each of the samples A through E is larger than the discharged amount in the sample F, it is judged that effective advantages are obtained in the gluteus maximus muscles.

As a result of the above experiment, although the discharged amount in the sample A was lower than the discharged amount in the sample F, the discharge amount of each of the samples B through E was higher than the discharged amount in the sample F. Therefore, the inventors of the present application have judged that effective advantages are obtained in the gluteus maximus muscles in the samples B through E. It should be noted that in this experiment, in addition to the discharged amount of the gluteus maximus muscles, the myoelectirc potentials of hamstring muscles (general term for biceps muscles, semitendinosus muscle, and semimembranosus muscle) were measured. As a result, it was discovered that, for the discharged amount of the hamstring muscles, the discharged amount of each of the samples B through E was larger than the discharged amount in the sample F, as with the case of the discharged amount of the gluteus maximus muscles. Specifically, it was discovered that the samples B through E are also effective in an exercise of kicking the legs backward. From these facts as well, it is clear that the samples B through E provide effective advantages in the gluteus maximus muscles.

Next, each of the samples A through F was put on the dummy M to measure the pressure applied to a predetermined measuring point on each of the samples A through F. The wearing pressure, when the garment is worn, in this case means the wearing pressure, when the garment is worn, received from the bottom garment. It should be noted that the measuring point in the present embodiment is the filler cloth intersecting par 3*ab* and a rear side section of a thigh on which the filler clothes are not formed. FIG. 12 is a figure showing the wearing pressure, when the garment is worn, at each measuring point on each of the samples A through F. As shown in FIG. 12, the wearing pressure, when the garment is worn, at the intersecting part on the sample A is 28.8 [gf/cm$^2$] and the wearing pressure, when the garment is worn, at the rear side section on same is 17.4 [gf/cm$^2$]. The wearing pressure, when the garment is worn, at the intersecting part on the sample B is 37.1 [gf/cm$^2$] and the wearing pressure, when the garment is worn, at the rear side section on same is 20.4 [gf/cm$^2$]. The wearing pressure, when the garment is worn, at the intersecting part on the sample C is 35.5 [gf/cm$^2$] and the wearing pressure, when the garment is worn, at the rear side section on same is 21.5 [gf/cm$^2$]. The wearing pressure, when the garment is worn, at the intersecting part on the sample D is 37.5 [gf/cm$^2$] and the wearing pressure, when the garment is worn, at the rear side section on same is 21.3 [gf/cm$^2$]. The wearing pressure, when the garment is worn, at the intersecting part on the sample E is 51.4 [gf/cm$^2$] and the wearing pressure, when the garment is worn, at the rear side section on same is 35.2 [gf/cm$^2$]. The wearing pressure, when the garment is worn, at the intersecting part on the sample F is 22.5 [gf/cm$^2$] and the wearing pressure, when the garment is worn, at the rear side section on same is 18.8 [gf/cm$^2$]. When the wearing pressure, when the garment is worn, exceeds 60.0 [gf/cm$^2$], the wearers mostly feel that the garment is tight.

The measuring device used in the measurement of the pressure at the measuring points is a contact pressure measuring device (airpack type) manufactured by AMI Co., Ltd. The specifications thereof are as follows: table type: AMI 3037-20; sensor section: 20 [mm] diameter; maximum measured value: approximately 15000 [Pa]; guide tube: 1.5 [m]. Further, in a method of measuring the wearing pressure, when the garment is worn, for example, a pressure sensor is attached to the dummy or a measuring section on a human body to measure the pressure applied from the bottom garment to the pressure sensor in a state in which the bottom garment is worn.

As a result of the experiment performed using the samples A through F, the following characteristics were discovered in regards to the tightening force of the main body portion 2 and the tightening force of the filler clothes 3.

(1) If the tightening force of the main body portion 2 is weak no effective advantage for the gluteus maximus muscles can be expected. (2) The stronger the tightening force of the filler clothes 3, the larger the effects on the gluteus maximus muscles.

As described above, the inventors of the present applications have reached a conclusion that if the wearing pressure, when the garment is worn, at the filler cloth intersecting part 3*ab* is less than 30 [gf/cm$^2$], effective advantages can hardly be expected on the gluteus maximus muscles, and if the wearing pressure, when the garment is worn, at the filler cloth intersecting part 3*ab* exceeds 60 [gf/cm$^2$], effects on the gluteus maximus muscles are significant but the wearers have a large feeling of tightness. Specifically, the inventors of the present application considered that if the wearing pressure, when the garment is worn, at the filler cloth intersecting part 3*ab* is approximately 30 through 60 [gf/cm$^2$], the bottom garment in which the gluteus maximus muscles are affected advantageously and the wearers do not feel tightness can be obtained. Moreover, the inventors of the present application have reached a conclusion that it is preferred that the wearing pressure, when the garment is worn, at the filler cloth intersecting part 3*ab* be 34 through 38 [gf/cm$^2$].

Furthermore, the inventors of the present application have reached a conclusion that it is preferred that the relationship among the wearing pressure, when the garment is worn, at the filler cloth intersecting part 3*ab*, the wearing pressure, when the garment is worn, at sections in the filler clothes 3 other than the intersecting part 3*ab*, and the wearing pressure, when the garment is worn, at sections other than the filler clothes 3 (main body portion 2) be expressed as "the wearing pressure, when the garment is worn, at the intersecting part>the wearing pressure, when the garment is worn, at the sections in the filler clothes 3 other than the intersecting part>the wearing pressure, when the garment is worn, at the sections other than the filler clothes 3 (main body portion 2). Specifically, the inventors of the present application have reached a conclusion that it is preferred that the wearing pressure, when the garment is worn, at the filler cloth intersecting part 3*ab* be 30 through 60 [gf/cm$^2$], the wearing pressure, when the garment is worn, at the sections in the filler clothes 3 other than the intersecting part be 15 through 50 [gf/cm$^2$], and the wearing pressure, when the garment is worn, at the sections in the filler clothes 3 other than the intersecting part be 0 through 30 [gf/cm$^2$].

Figure 13:
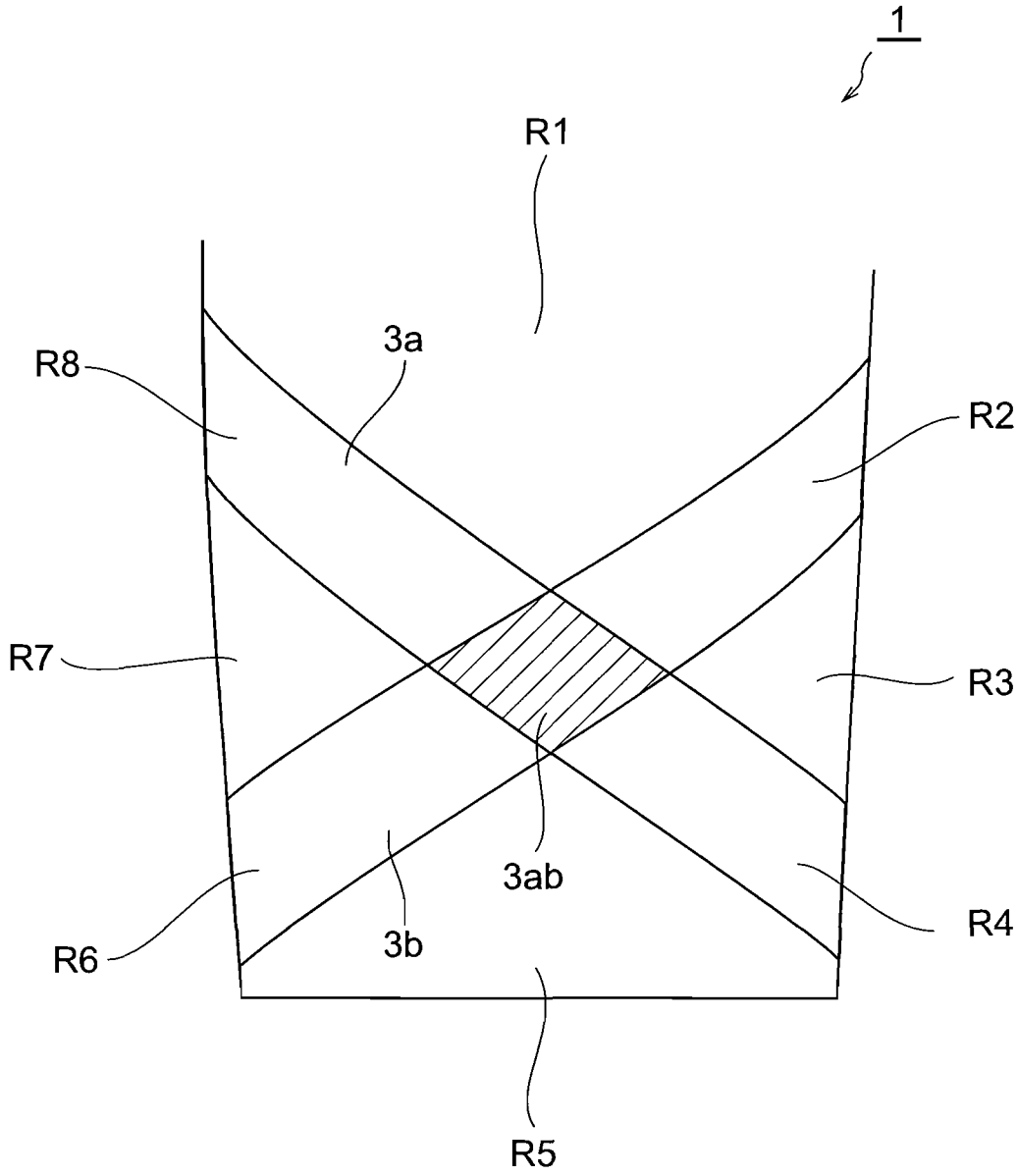
FIG. 13 is a figure showing eight peripheral regions around an intersecting part of a sample.

Next, the inventors of the present application created a sample in which the wearing pressure, when the garment is worn, at the filler cloth intersecting part 3*ab* is 34.6 [gf/cm$^2$]. Then, the pressures at eight peripheral regions around the intersecting part on this sample was measured. Here, the eight peripheral regions are explained with reference to FIG. 13. FIG. 13 is a figure in which a part of a right thigh is viewed from the front. As shown in this figure, of the eight peripheral regions R1 through R8, R1 is an upper region with respect to the intersecting part, R2 is an upper right region with respect to the intersecting part, R3 is a right region with respect to the intersecting part, R4 is a lower right region with respect to the intersecting part, R5 is a lower region with respect to the intersecting part, R6 is a lower left region with respect to the intersecting part, R7 is a left region with respect to the intersecting part, and R8 is an upper left region with respect to the intersecting part.

As a result of the abovementioned measurement, the wearing pressure, when the garment is worn, at the region R1 is 9.5 [gf/cm$^2$], the wearing pressure, when the garment is worn, at the upper right region R2 is 28.6 [gf/cm$^2$], the wearing pressure, when the garment is worn, at the right region R3 is 14.4

[gf/cm$^2$], the wearing pressure, when the garment is worn, at the lower right region R4 is 22.8 [gf/cm$^2$], the wearing pressure, when the garment is worn, at the lower region R5 is 11.7 [gf/cm$^2$], the wearing pressure, when the garment is worn, at the lower left region R6 is 26.9 [gf/cm$^2$], the wearing pressure, when the garment is worn, at the left region R7 is 17.8 [gf/cm$^2$], and the wearing pressure, when the garment is worn, at the upper left region R8 is 25.3 [gf/cm$^2$]. Further, the wearing pressure, when the garment is worn, on the back of the thigh where the filler clothes 3 are not formed was 18.1 [gf/cm$^2$].

Of the pressures at the peripheral regions R1 through R8, the minimum value is 9.5 [gf/cm$^2$] at the upper region R1, and the maximum value is 28.6 [gf/cm$^2$] at the upper right region R2. Therefore, it is understood that the wearing pressure, when the garment is worn, at the filler cloth intersecting part 3*ab* is approximately 1.2 through 3.7 times the wearing pressures, when the garment is worn, at the peripheral regions R1 through R8.

Of the peripheral regions, the peripheral region in the filler clothes 3 are four peripheral regions of the upper right region R2, the lower right region R4, the lower left region R6, and the upper left region R8. Of the wearing pressures, when the garment is worn, at these four peripheral regions, the minimum value is 22.8 [gf/cm$^2$] at the lower right region R4, and the maximum value is 28.6 [gf/cm$^2$] at the upper right region R2. Therefore, it is understood that the wearing pressure, when the garment is worn, at the filler cloth intersecting part 3*ab* is approximately 1.2 through 1.6 times the wearing pressures, when the garment is worn, at these four peripheral regions R2, R4, R6, and R8.

Of the peripheral regions, the peripheral regions in the sections other than in the filler clothes 3 are four peripheral regions of the upper region R1, the right region R3, the lower region R5, and the left region R7. Of the wearing pressures at these four peripheral regions, the minimum value is 9.5 [gf/cm$^2$] at the upper region R1, and the maximum value is 17.8 [gf/cm$^2$] at the left region R7. Therefore, it is understood that the wearing pressure at the filler cloth intersecting part 3*ab* is approximately 1.9 through 3.7 times the wearing pressures, when the garment is worn, at these four peripheral regions R1, R3, R5, and R7.

Further, since the wearing pressure, when the garment is worn, on the back of the thigh is 18.1 [gf/cm$^2$], it is understood that the wearing pressure, when the garment is worn, at the filler cloth intersecting part 3*ab* is approximately 1.9 times the wearing pressure, when the garment is worn, at the back of the thigh.

Next, the inventors of the present application created a sample obtained by removing the filler clothes besides the intersecting part 3*ab* from the sample in which the wearing pressure, when the garment is worn, at the filler cloth intersecting part 3*ab* is 34.6 [gf/cm$^2$], i.e. a sample which does not have a cross structure. By removing the filler clothes besides the intersecting part 3*ab* from the sample having the cross structure, the pressure at the filler cloth part on the sample which does not have the cross structure has reduced to 28.7 [gf/cm$^2$]. It can be considered that this is because the tension is hardly applied to the belly muscle of the rectus femoris muscle by removing the filler clothes other than the intersecting part 3*ab*. Accordingly, the pressure was reduced below 30 [gf/cm$^2$] at which it is confirmed that effective advantages on the gluteus maximus muscle are obtained.

For such a sample which does not have the cross structure, the wearing pressures, when the garment is worn, at the eight peripheral regions around the filler cloth part on the sample which does not have the cross structure were measured, as with the case of the sample having the cross structure.

As a result of the measurement, the wearing pressure, when the garment is worn, at the upper region was 13.4 [gf/cm$^2$], the wearing pressure, when the garment is worn, at the upper right region was 18.9 [gf/cm$^2$], the wearing pressure, when the garment is worn, at the right region was 17.5 [gf/cm$^2$], the wearing pressure, when the garment is worn, at the lower right region was 17.5 [gf/cm$^2$], the wearing pressure, when the garment is worn, at the lower region was 16.9 [gf/cm$^2$], the wearing pressure, when the garment is worn, at the lower left region was 18.6 [gf/cm$^2$], the wearing pressure, when the garment is worn, at the left region was 17.2 [gf/cm$^2$], and the wearing pressure, when the garment is worn, at the upper left region was 21.9 [gf/cm$^2$]. Moreover, the wearing pressure, when the garment is worn, at the back of the thigh where the filler clothes 3 are not formed was 17.5 [gf/cm$^2$].

Of the pressures at these peripheral regions, the minimum value is 13.4 [gf/cm$^2$] at the upper region, and the maximum value is 21.9 [gf/cm$^2$] at the upper left region. Therefore, it is understood that the wearing pressure, when the garment is worn, at the filler cloth part is approximately 1.3 through 2.2 times the wearing pressures, when the garment is worn, at the peripheral regions.

Further, since the wearing pressure, when the garment is worn, on the back of the thigh is 17.5 [gf/cm$^2$], it is understood that the wearing pressure, when the garment is worn, at the filler cloth part is approximately 1.6 times the wearing pressure, when the garment is worn, at the back of the thigh.

Here, the widths and shapes of the filler clothes 3 are explained with reference to FIG. 13. The filler clothes 3 shown in FIG. 13 are formed with straight clothes having substantially the same width, but the widths and shapes of the filler clothes 3 are not limited to these [clothes]. For example, the width of the filler cloth 3*a* shown in FIG. 13 may be wider than the width of the filler cloth 3*b*. Specifically, for example, the width of the filler cloth 3*a* may be 4.5 [cm] and the width of the filler cloth 3*b* may be 5.5 [cm]. Moreover, for example, the widths of the filler clothes 3 may be made uneven so that the inner side is narrower than the outer side. Specifically, for example, the width of the filler cloth 3*b* in the right region R3 shown in FIG. 13 and the width of the filler cloth 3*b* in the intersecting part 3*ab* may be 5.5 [cm], and the width of the filler cloth 3*b* in the upper right region R2 may taper from the intersecting part toward the right end side (for example, the width at the intersecting part side may be 5.5 [cm] and the width at the right end side may be 3.5 [cm]). Further, the shapes of the filler clothes 3 may be curved. Specifically, for example, the shape of the filler cloth 3*b* shown in FIG. 13 may be curved so that the upper side thereof is convex. By configuring the widths and shapes of the filler clothes 3 as described in the above specific examples, an effect can be obtained in which a stronger tightening force (power) is applied to the outer side section of thighs. This is because of the fact that, when a leg is kicked backward while walking, the quadriceps flexes, thereby flexing the front face of the thigh or particularly the front and outer side of the thigh, thus the tightening force of the filler clothes abutting on the outer side of the thigh is enhanced, thereby improving the support effect.

Next, FIG. 14 is used to explain the feeling of tightness elicited from ten testers who wore the sample having the cross structure for one month. As shown in FIG. 14, six out of the ten testers evaluated that their buttocks have risen compared to prior to execution of a trial. Further, one out of the ten testers evaluated that his buttocks became larger compared to prior to execution of the trial, while five out of the ten testers evaluated that their buttocks became smaller compared to prior to execution of the trial. Furthermore, nine out of the ten testers evaluated that their thighs became thinner compared to prior to execution of the trial. Moreover, eight out of the ten testers evaluated that the sample was comfortable.

There were specific example answers of the wearers, such as "buttocks became firm and tight" (four out of ten), "jeans fits smoothly" (three out of ten), "a space is created between thighs" and the like.

When the shapes of the buttocks of the testers were actually measured before and after the period of the trial, it was confirmed in eight out of the ten testers that the shape of their buttocks have changed. Out of the testers whose shapes of the buttocks have changed, for those testers who used to have slack buttocks, it was confirmed that their buttocks have risen, and for those testers whose buttocks were not slack before, it was confirmed that from the gluteal fold to thighs become lean. It should be noted that for two testers from which no changes in the shapes of their buttocks were observed, it was confirmed that they took only 5000 steps a day. According to the national nutrition survey, the average number of steps is 8200 for men and 7300 for women. Therefore, since these two testers from which no changes in the shapes of their buttocks were observed did not have much time to wear the sample and walk, it is considered that the shape of their buttocks have not changed. Other monitors different from these ten monitors were allowed to wear a girdle without the filler clothes for one month, but the shape of their buttocks did not change.

It should be noted in the above embodiment that the filler clothes formed on the bottom garment 1 were formed in an "x" shape when viewed from the front, but the shape of the filler clothes is not limited to the shape of an "x". For example, the shape of the filler clothes may be the shape of a "+". In other words, it is preferred that the filler clothes intersecting with each other and that the middle point between the interspinal point and patellar midpoint be positioned in the intersecting part.

Furthermore, in the above embodiment, the two strip-shaped filler clothes 3*a* and 3*b* (tightening portions) were formed so that the filler clothes intersect with each other, but a filler cloth out of the filler clothes, which is formed besides the intersecting part 3*ab*, may be removed so that only the intersecting part 3*ab* is formed. In this case, preferably the filler clothes and the main body portion are configured such that the wearing pressure, when the garment is worn, at the filler clothes is at least 30 [gf/cm$^2$], the wearing pressure, when the garment is worn, at sections other than the filler clothes (main body portion) is 30 [gf/cm$^2$] or less, and the differential wearing pressure, when the garment is worn, between the pressure at the filler clothes and the wearing pressure, when the garment is worn, at the sections other than the filler clothes is at least 10 [gf/cm$^2$]. Accordingly, the quadriceps can be stimulated without giving a tight feeling to the wearers, thus a bottom garment in which the gluteus maximus muscle can be used and which does not provide a feeling of tightness to the wearer can be provided.

Moreover, in the above embodiment, the tightening portions are formed by using the filler clothes on the bottom garment 1, but the clothes to be used for forming the tightening portions are not limited to the filler clothes. For example, a dart may be used. Further, the main body portion and the tightening portion may be switched by power switching of warp knitting or circular knitting (circular knitting). Further, a bone or polyurethane resin may be added to a cloth corresponding to the tightening portion to add a strong tightening force to the cloth.

It is preferred that a highly elastic material be used for a crotch section of the bottom garment in the above embodiment. This is performed so that a movement of increasing the length of stride is not obstructed, since the length of stride increases when walking in the bottom garment of the embodiment.

Moreover, the above embodiment describes the girdle as the bottom garment, but the present invention can be applied to a garment other than the girdle. For example, the present invention can be applied to a bottom garment such as a pair of spats, men's spats, stockings, tights, supporters, and a suspender belt.

The basic configuration of the present invention is a point that, in the bottom garment, the tightening portions are provided at the front section of a thigh, i.e. the section corresponding to the middle point between the interspinal point and the patellar midpoint, whereby the quadriceps can be stimulated and the movement of the quadriceps is not obstructed. Accordingly, the wearer can kick his legs backward significantly in a natural fashion so that the gluteus maximus muscle is used. Therefore, only by walking in the bottom garment of the present invention, natural tight buttocks can be realized. With such a configuration, various embodiments in addition to the above embodiment can be realized. For example, the tightening portions may be formed into shapes other than the shapes of the filler clothes of the embodiment.

The invention claimed is:

1. A wearable bottom garment having a front portion and a rear portion, comprising:

a main body portion including a groin portion and two leg portions, each leg portion comprising a thigh portion and a tightening portion, wherein the tightening portion comprises a first tightening portion and a second tightening portion, wherein upon use the pressure applied to the wearer by the first and second tightening portions is greater than the pressure applied to the wearer by the main body portion, wherein the first tightening portion extends from a starting point at the groin portion on the front portion, then extending around the front of the thigh portion, and further extending obliquely downwards to an end point at the outside of the leg portion on the front portion without extending to the rear portion, the second tightening portion extending from a single starting point at an area at substantially the same height as the groin portion, the area being on the outside of the leg portion on the front portion, then extending around the front of the thigh portion, and further extending obliquely downwards to an end point at the inside of the leg portion on the front portion without extending to the rear portion, wherein the first and second tightening portions intersect at a section corresponding to a middle point between an interspinal point and a patellar midpoint of the wearer's body, the intersect section being located at the front side of the thigh portion of the wearer, and wherein the first tightening portion and the second tightening portion are connected to each other and to the garment but to no other tightening portion.

2. The wearable bottom garment according to claim 1, wherein the middle point is located within a region in which the ratio between a length extending from the interspinal point to the middle point and a length extending from the middle point to the patellar midpoint of the wearer is between 4:6 and 6:4.

* * * * *